United States Patent [19]

Mitter

[11] 3,965,816

[45] June 29, 1976

[54] DRIVE FOR ROTARY SCREEN PRINTER UTILIZING THE ROLLER SQUEEGEE

[75] Inventor: Mathias Mitter, Verl, Germany

[73] Assignee: Mitter & Co., Schloss Holte, Germany

[22] Filed: July 15, 1974

[21] Appl. No.: 488,719

[30] Foreign Application Priority Data

July 19, 1973 Germany ..... 2336734

[52] U.S. Cl. ..... 101/115; 101/116; 101/120

[51] Int. Cl.[2] ..... B41F 15/10; B41F 15/42

[58] Field of Search ..... 101/115, 116, 119, 120, 101/121, 122

[56] References Cited

UNITED STATES PATENTS

| | | | |
|---|---|---|---|
| 2,698,574 | 1/1955 | Dougherty et al. | 101/120 |
| 3,572,240 | 3/1971 | Bohm | 101/116 |
| 3,731,357 | 5/1973 | Shirai | 29/116 AD |
| 3,774,534 | 11/1973 | Ichinose | 101/119 |
| 3,811,378 | 5/1974 | Bohm | 101/116 X |
| 3,837,277 | 9/1974 | Jaffa et al. | 101/127.1 |

FOREIGN PATENTS OR APPLICATIONS

| | | | |
|---|---|---|---|
| 546,145 | 2/1974 | Switzerland | 101/127.1 |

*Primary Examiner*—Edgar S. Burr
*Assistant Examiner*—R. E. Suter
*Attorney, Agent, or Firm*—Michael J. Striker

[57] ABSTRACT

A screen printing machine wherein one end of a rotary stencil is driven by a power train which receives torque from a motor. The other end of the stencil is driven by the power train through the medium of a cylindrical squeegee which is disposed in the stencil and drives an idler gear in the frame of the machine. The idler gear rotates a gear which drives the other end of the stencil. The ends of the stencil are coupled to driving sleeves which are rotatable in discrete bearing members each of which is adjustable relative to the machine frame. That bearing member which receives the driving sleeve for the one end of the stencil is pivotable in the frame about an axis which is normal to the axis of the stencil and is also movable in the axial direction of the stencil. The other bearing member is pivotable in the frame about an axis which is normal to the axis of the stencil and is also movable transversely of the axis of the stencil.

19 Claims, 3 Drawing Figures

DRIVE FOR ROTARY SCREEN PRINTER UTILIZING THE ROLLER SQUEEGEE

BACKGROUND OF THE INVENTION

The present invention relates to screen printing machines in general, and more particularly to improvements in screen printing machines of the type where in a tubular stencil surrounds a rotary squeegee and is mounted in two spaced apart bearing members or heads at least one of which is adjustable relative to the frame of the screen printing machine.

The commonly owned Swiss Pat. No. 546,145 discloses a screen printing machine wherein each bearing member is adjustable in several directions so as to insure that the stencil can apply ink or another liquid to predetermined portions of a web of fabric which travels below the stencil along the upper side of a platform or table. In order to insure that the stencil will rotate at a desired speed and to simultaneously avoid undesirable twisting of the stencil, the screen printing machine normally comprises two discrete drives, one for each end portion of the stencil. This contributes to the initial and maintenance cost of the machine. It is further known to subject the stencil to substantial tensional (axial) stresses and to provide a drive which transmits torque to one end of the tensioned stencil. The tensioning is intended to prevent twisting of the stencil in view of the fact that only one end of the stencil is positively driven. Such proposals have met with limited success since the stencil cannot be tensioned at will because its material is incapable of standing substantial axial stresses. Therefore, the permissible tensioning of the stencil is insufficient to prevent the development of pronounced torsional stresses and the resulting twisting of the stencil when the drive means merely transmits torque to one end of the stencil. In other words, the tensioning of a stencil merely reduces but does not eliminate the danger of twisting when the drive means is designed to transmit torque to one end of the stencil.

Additional problems arise when the end portions of the stencil are mounted in adjustable bearing members, i.e., in bearing members which are movable relative to the frame of the screen printing machine. As a rule, the bearing members support rotatable driving sleeves which are coupled to the respective end portions of the stencil and each of which receives torque from a discrete bevel gear transmission. The input members of the transmission receive motion from the main prime mover, preferably through the medium of a roller which drives the back cloth for the fabric. At least one of the bearing members is pivotable about an axis which is normal to the axis of the stencil to thus enable the attendants to eliminate misalignment of imprints which are applied to the fabric at successive printing stations. Since the aforementioned driving sleeves are rotated by gear trains, any pivoting of a bearing member in the frame will produce substantial twisting stresses which tend to deform the stencil as soon as the pivotable bearing member is caused to leave its neutral position. The likelihood of twisting of the stencil is especially pronounced when the machine comprises two discrete drives, one for each end of the stencil. Thus, when one of the bearing members is pivoted from its neutral position, the gear which rotates the driving sleeve at the other end of the stencil acts not unlike a fixedly mounted toothed rack and causes the repsective driving sleeve to turn together with the respective end portion of the stencil. This can cause a total destruction or extensive deformation of the stencil. Attempts to prevent such undesirable twisting include the provision of manually operated means for rotating the gears at that end of the stencil which is supported by the pivotable bearing member. However, this causes the stencil to change its position relative to the fabric so that the pivoting of one bearing member for the purpose of eliminating one defect in alignment entails a different type of misalignment between the stencil and the fabric.

SUMMARY OF THE INVENTION

An object of the invention is to provide novel and improved means for driving the stencil or stencils in a screen printing machine.

Another object of the invention is to provide a screen printing machine with novel and improved means for driving a stencil whose end portions are supported by bearing members at least one of which is adjustable in several directions with respect to the frame of the screen printing machine.

A further object of the invention is to provide a screen printing machine wherein the drive means for the stencil or stencils is constructed and assembled in such a way that the stencils are not subjected to pronounced torsional stresses in response to pivoting about axes which are normal to their axes.

An additional object of the invention is to provide a screen printing machine wherein the stencil or stencils can be positively driven at both ends even though the drive means for the stencil or stencils employs a single prime mover which need not be directly connected with both ends of a stencil.

Still another object of the invention is to provide a screen printing machine wherein the prime mover of the drive means for one or more stencils is directly connected to only one end of each stencil yet the stencils are held against twisting even though they need not be subjected to substantial tensional stresses.

A further object of the invention is to provide a screen printing machine wherein each of the two bearing members for the ends of a rotary stencil can be moved in several directions without necessitating manual adjustment of the torque transmitting means during movement of a bearing member to any one of a practically unlimited number of different positions with respect to the machine frame.

The invention is embodied in a screen printing machine which comprises a frame, first and second preferably upright bearing members mounted in the frame, an elongated hollow stencil (e.g., a cylinder) having first and second end portions rotatably supported by the first and second bearing members, a prime mover, a first power train which drivingly connects the prime mover with the first end portion of the stencil, and a second power train which drivingly connects the first power train with the second end portion of the stencil. The second power train comprises a rotary squeegee which is disposed in the interior of the stencil, means for transmitting torque from the first power train to the squeege in the region of the first end portion of the stencil, and means for transmitting torque from the squeegee to the second end portion of the stencil. The means for transmitting torque from the squeegee to the second end portion of the stencil preferably comprises an idler gear which is rotatably mounted in the frame.

The first bearing member is preferably pivotable in the frame about a first axis which is normal to the axis of the stencil and is further movable in the axial direction of the stencil. The second bearing member is preferably pivotable in the frame about a second axis which is normal to the axis of the stencil and is further movable transversely of the axis of the stencil. The machine comprises means, e.g., nuts, which serves to fix the bearing members in selected positions with respect to the frame.

The novel features which are considered as characteristic of the invention are set forth in particular in the appended claims. The improved drive means itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
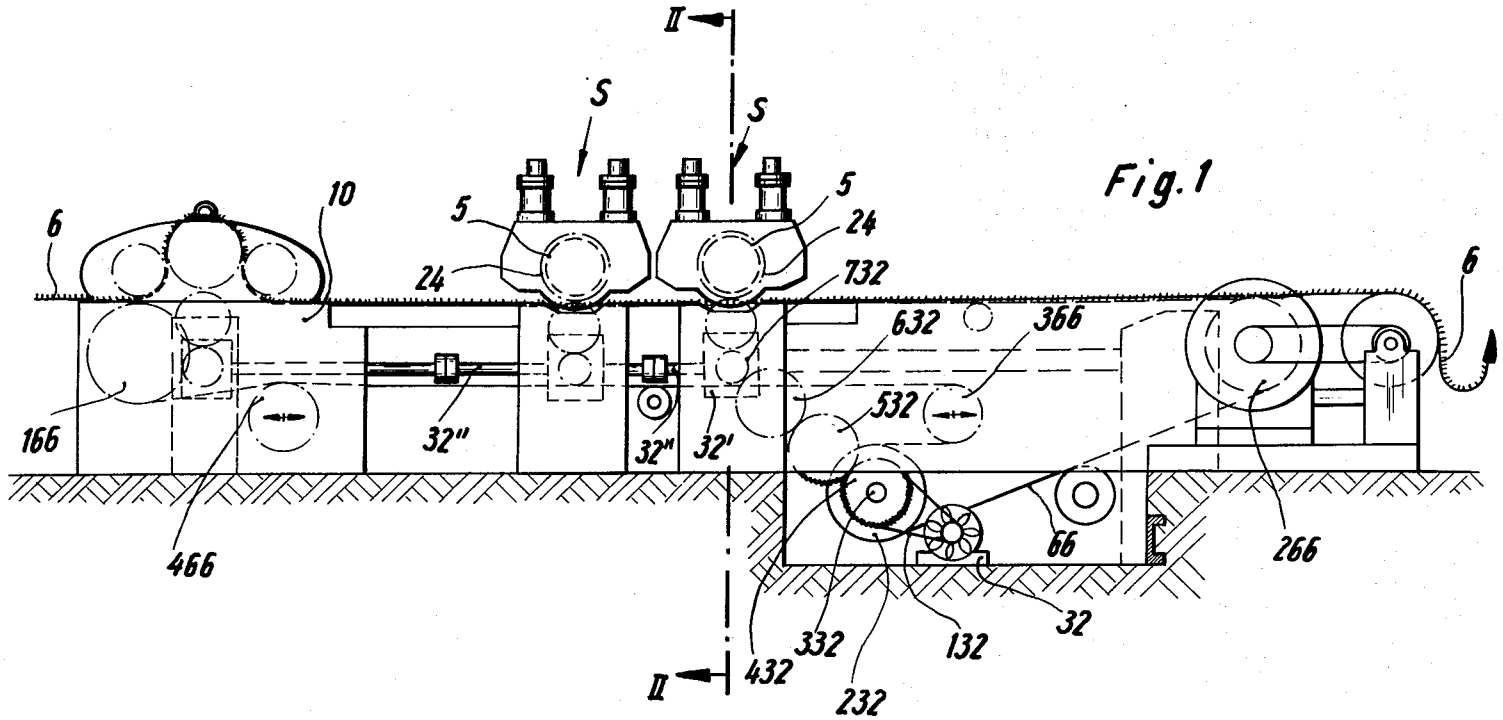
FIG. 1 is a schematic elevational view of screen printing machine with two printing units wherein the stencils are driven in accordance with the invention.

The improved screen printing machine comprises a frame 10 which supports one or more screen printing units S (two shown in FIG. 1). Each printing unit S comprises a hollow cylindrical screen or stencil 5 whose ends are secured to annular holders 3 and 4. The holders 3, 4 receive torque from two driving sleeves 20, 20' which are respectively mounted in adjustable bearing members or heads 1, 2 and are respectively connected to the adjacent holders 3, 4 by axially parallel coupling pins 31, 31'. The outer end portions of the driving sleeves 20, 20' are rigid with gears 24, 24'.

Figures 2, 3:
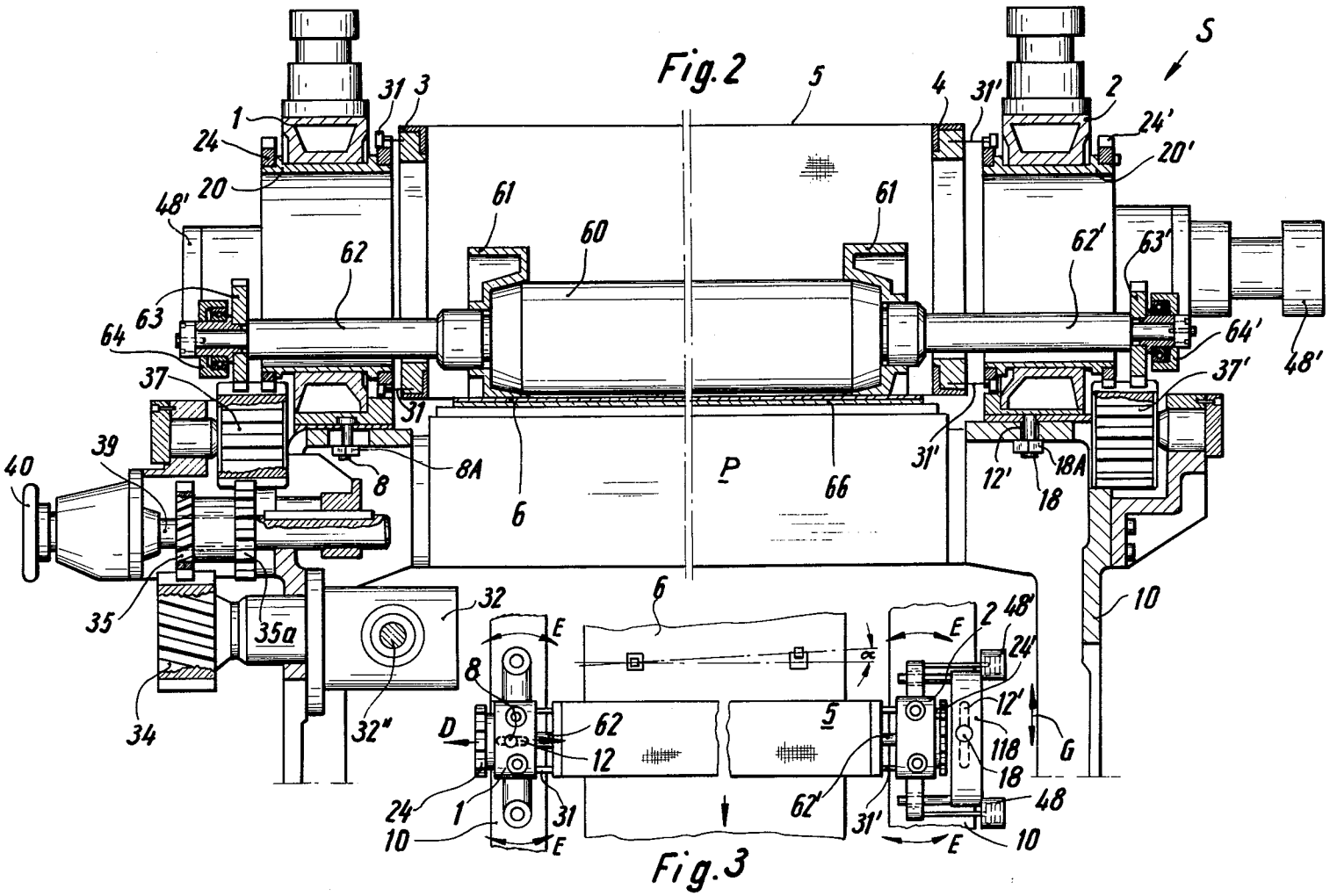
FIG. 2 is an enlarged partly side elevational and partly longitudinal vertical sectional view of a printing unit substantially as seen in the direction of arrows from the line II—II of FIG. 1.
FIG. 3 is a smaller-scale plan view of the structure shown in FIG. 2.

The bearing members or heads 1, 2 for a stencil 5 are respectively provided with vertical posts 8, 18 which are slidable in slots 12, 12' provided therefor in the frame 10. The slot 12 for the post 8 is parallel to the axis of the stencil 5 and the slot 12' for the post 18 extends transversely of such axis (see FIG. 3). The manner in which the posts 8, 18 are movable relative to the frame 10 is disclosed in considerable detail in the commonly owned Swiss Pat. No. 546,145 to which reference may be had if necessary a paraphrase of the pertinent portions of that patent appears near the end of this specification. The left-hand head 1, as viewed in FIG. 2 or 3, is pivotable about the axis of the post 8 in directions indicated by double-headed arrows E, and the head 1 is further movable axially of the stencil 5, as indicated by the arrows D. The movement in directions indicated by arrows D necessitates the loosening of a fixing or arresting nut 8A (FIG. 2) before the post 8 is free to move lengthwise of the slot 12. The nut 8a is thereupon tightened to fix the head 1 in the selected position.

The second bearing member or head 2 is pivotable about the axis of the respective post 18 as indicated by the double-headed arrows E shown in FIG. 3. In addition, the head 2 is movable transversely of the axis of the stencil 5 upon loosening of a fixing nut 18A which normally bears against the frame 10 below the slot 12'. The directions in which the head 2 is adjustable lengthwise of the slot 12' are indicated by a double-headed arrow G.

The means for rotating the stencil 5 with respect to the heads 1 and 2 is illustrated in FIG. 1. Such rotating means comprises a main prime mover 32 (e.g., an electric motor) which drives a roller 232 through the medium of a chain or belt transmission 132. The endless back cloth 66 for the fabric 6 is trained over the roller 232 and over two pulleys 166, 266 which are mounted in the frame 10. The back cloth 66 is tensioned by two adjustable rolls 366 and 466. The shaft 332 of the roller 232 carries a gear 432 which drives intermediate gears 532, 632 and 732. The gear 732 drives the input element of a bevel gear transmission 32' having two output members including a first output member which rotates the gear 24 for the stencil 5 of the right hand printing unit S, as viewed in FIG. 1, and a second output element 32'' which drives the screen 5 of the left-hand printing unit S, as viewed in FIG. 1, as well as certain other parts shown in the left-hand portion of FIG. 1. It is clear that the illustrated transmission 32' can be replaced by other suitable torque transmitting means which can transmit motion to a series of successive stencils.

The manner in which the transmission 32' of FIG. 1 drives one of the stencils 5 is shown in the left-hand portion of FIG. 2. The first output element of the transmission 32' drives a helical gear 34 which constitutes a main drive gear for the respective stencil 5. This gear meshes with a helical blocking gear 35 which is coaxial with a spur gear **35*a* meshing with a relatively wide spur gear 37 which can be called an intermediate gear. The gear 37 meshes with a spur gear 63 which is rigid with the left-hand stub 62 of a rigid cylindrical squeegee 60 and also with the gear 24 on the driving sleeve 20 for the stencil 5. The axes of gears 37, 24 and 63 may be located in a common plane. Due to the provision of helical teeth on the gears 34 and 35, an axial movement of the gear 35 through the medium of a hand wheel 40 which can axially displace a feed screw 39 (on which the helical gear 35 rotates), entails an angular movement of the stencil 5 which is desirable to correct certain errors in the transfer of ink or other liquid onto the fabric 6** (refer again to the aforementioned Swiss Pat. No. 546,145) a paraphase of the pertinent portions of that patent appears near the end of this specification.

It will be seen that the just described first power train transmits torque to one end of the stencil 5 which is shown in FIG. 2. The gear 24' on the other driving sleeve 20' for the stencil 5 is rotated as follows: The squeegee 60 in the lower portion of the space within the stencil 5 has a second stub 62' which extends with clearance through the sleeve 20' and is non-rotatably connected to a gear 63' which meshes with a relatively wide idler gear 37'. The latter gear further meshes with the gear 24' on the driving sleeve 20'. The gear 37' is freely rotatable on a shaft in the frame 10. The lowermost teeth of the gears 63' and 24' are aligned with each other and are located at the same level to extend into one and the same tooth space of the idler gear 37'. This also applies for the gears 24, 37 and 63. The axes of gears 24' and 63' are coplanar with the axis of the idler gear at least at times.

The provision of gears 63', 24', 37' insures that the stencil 5 is not subjected to any (or is subjected to negligible) twisting stresses when the motor 32 drives the gear 37.

48'means for stressing the stencil 5 in the axial direction comprises two fluid-operated cylinder and piston units 43' which are adjacent to the head 2 and operate in a manner as disclosed in the Swiss Pat. No. 546,145 a paraphrase of the pertinent portions of that patent appears near the end of this specification. When the head 2 is moved in one of the directions indicated by the double-headed arrow G, the idler gear 37' does not subject the stencil 5 to any torsional stresses because it is free to rotate in the frame 10. FIG. 2 shows that the head 2 may be assembled of two sections one of which carries the driving sleeve 20' and the other of which carries the post 18. The one section (which carries the driving sleeve 20') is movable axially of the stencil 5 by the cylinder and piston units 48 and 48'. If the post 18 is moved lengthwise of the slot 12' in the frame 10, the idler gear 37' merely rotates about its axis but does not entail a rotation of the gears 24' and 63'. Thus, by loosening the nut 18A, by thereupon changing the position of the post 18 in the slot 12', and by again tightening the nut 18A, an attendant can change the inclination of the axis of the stencil 5 relative to the direction of lengthwise movement of the fabric 6 without any undesirable stressing (especially twisting) of the stencil 5.

In other respects, the screen printing machine of FIGS. 1–3 can (but need not) be constructed, assembled, and its heads 1, 2 adjusted in a manner as disclosed in the Swiss Pat. No. 546,145. The main difference between the patented machine which is shown in FIGS. 1–3 is that the latter machine uses the squeegee 60 as a means for insuring that the stencil 5 is driven at both ends even though the power train which receives motion from the main prime mover 32 only transmits torque to one end portion (driving sleeve 20) of the stencil 5. The end portions of the squeegee 60 can carry lateral seals or barriers 61 for ink which is supplied by a manifold of conventional design.

When the squeegee 60 is replaced with a larger or smaller squeegee, the spacing of teeth on the gears 63, 63' of the larger or smaller squeegee is preferably changed accordingly.

The heads 1 and 2 respectively carry interchangeable antifriction bearings 64 and 64' which receive the adjacent end portions of the stubs 62. The bearings 64 and 64' can constitute bridge elements between the heads 1, 2 and the adjacent cylinder and piston units 48, 48'. As a rule, the bearings 64, 64' are respectively adjustable with the heads 1 and 2. When the head 2 comprises two sections, the bearing 64' can be supported by a plate 118 shown in FIG. 3.

The reference character P (FIG. 2) denotes a platform or table for the upper stretch of the back cloth 66.

An important advantage of the improved screen printing machine is that the initial and maintenance cost of drive means for the stencil 5 of a printing unit S is only a fraction of the cost of a drive means which directly transmits torque to both end portions of a stencil. Moreover, the transmission of torque from the positively driven end to the stencil 5 through the medium of the associated squeegee 60 renders it possible to adjust the heads 1 and 2 in several directions by resorting to a relatively simple, compact, rugged and inexpensive adjusting mechanism. The angle alpha (FIG. 2) indicates the direction of angular adjustment which is necessary to properly align the imprints which are made on the fabric 6 by the stencils of the two printing units S. Such adjustment can be effected by pivoting the entire stencil 5 of FIG. 2 clockwise about the axis of the post 8, i.e., by moving the post 18 downwardly, as viewed in FIG. 2. This adjustment can be carried out with a high degree of accuracy so that the machine need not be equipped with precision adjusting means for the stencils.

The stability of the squeegee 60 is much more pronounced than that of the relatively unstable stencil 5. Therefore, the squeegee can rotate the driving sleeve 20' without causing any torsional stressing of the stencil because the squeegee is highly unlikely to be twisted while its stub 62 receives torque from the power train for that end portion of stencil 5 which is adjacent to the bearing member 1 and while the stub 62' transmits torque to the driving sleeve 20' for the other end portion of the stencil.

A further important advantage of the improved means for rotating the stencil 5 is that the angular position of one end portion of the stencil with respect to the other end portion does not change at all when the head 2 is moved lengthwise of the slot 12' in the frame 10. This attributed to the provision of the idler gear 37' which is freely rotatable in the frame 10 and does not act as a rigid toothed rack when the fixing nut 18A is loosened and the post 18 is moved lengthwise of the slot 12'. Such movement of the post 18 entails an angular movement (angle alpha) of the line of contact between the peripheral surface of the stencil 5 and the upper side of a fabric 6 on the upper stretch of the back cloth 66; however, the line of contact remains straight because the stencil is not twisted at all. Consequently, the movement of post 18 lengthwise of the slot 12' need not be followed by any secondary adjustments, such as an untwisting of the stencil after the post 18 assumes a new position in the slot 12' and the nut 18A is applied to fix the post 18 in the new position. It can be said that the provision of idler gear 37' obviates two secondary adjustments which are necessary in presently known screen printing machines, namely an untwisting of the stencil and the following additional adjustment which is necessary as a result of untwisting of the stencil.

Paraphrased, the pertinent portions of the Swiss Pat. No. 546,145 state that a spindle may be provided which can be turned via a handwheel to press against the plate having the slot 12', to shift the plate laterally and obtain the movement of the screen 5 as indicated in FIG. 3 of the present disclosure. The bearing 2 is supported on a pivot bearing and carried by a carrier sleeve from which arms extend having eyelets through which bolts extend that are oriented parallel to the elongation of the screen; the eyelets slide on these bolts. An extensible linkage connects the arms with the cylinder and piston units 48 so that, when the same are operated, the bearing 2 can be moved away from the bearing 1 and the screen 5 can be longitudinally stressed.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In a screen printing machine, a combination comprising a frame; first and second bearing members mounted in said frame; an elongated hollow stencil having first and second end portions rotatably supported by said first and second bearing members; a prime mover; a first power train drivingly connecting said prime mover with said first end portion of said stencil; and a second power train drivingly connecting said first power train with said second end portion of said stencil, and a second power train drivingly connecting said first power train with said second end portion of said stencil, said second power train including a rotary squeegee disposed in the interior of said stencil, first torque-transmitting torque from said first power train to said squeegee, and second torque transmitting means including an idler which is freely rotatably mounted in said frame, a first gear on said squeegee and meshing with said idler gear and a second gear acting upon said second end portion of said stencil and also meshing with said idler gear, for transmitting torque from said squeegee to said second end portion of said stencil in the region of said second bearing member without transmitting twisting stresses to said stencil.

2. A combination as defined in claim 1, wherein at least one of said bearing members is adjustable relative to said frame in at least one direction, and further comprising means for fixing said at least one adjustable bearing member in a selected position relative to said frame.

3. A combination as defined in claim 1 wherein said second bearing member is adjustable in said frame in directions substantially at right angles to the axis of said stencil and further comprising means for fixing said second bearing member in a selected position relative to said frame.

4. A combination as defined in claim 1, wherein said bearing members are respectively pivotable relative to said frame about first and second axes which are normal to the axis of said stencil, one of said bearing members being further movable relative to said frame in the axial direction of said stencil and the other of said bearing members being movable relative to said frame transversely of the axis of said stencil, and further comprising first and second means for repsectively fixing said first and second bearing members in selected positions with respect to said frame.

5. A combination as defined in claim 4, wherein said one bearing member has a first post defining said first axis and said frame has a slot receiving a portion of said first post and extending in the axial direction of said stencil, said other bearing member having a second post defining said second axis and said frame having a second slot receiving a portion of said second post and extending transversely of the axis of said stencil.

6. A combination as defined in claim 1, wherein said first power train comprises a transmission driven by said prime mover, a main drive gear rotated by said transmission, a further gear meshing with said main drive gear, an intermediate gear driven by said further gear, and a gear meshing with said intermediate gear and driving said first end portion of said stencil.

7. A combination as defined in claim 6, wherein said transmission is a bevel gear transmission.

8. A combination as defined in claim 6, wherein said first bearing member is pivotable with respect to said frame about an axis which is normal to the axis of said stencil and is movable in said frame axially of said stencil, and further comprising means for fixing said first bearing member in a selected position relative to said frame.

9. A combination as defined in claim 8, wherein said second bearing member is pivotable in said frame about an axis which is normal to the axis of said stencil and is movable in said frame transversely of the axis of said stencil, and further comprising means for fixing said second bearing member in a selected position relative to said frame, said second torque transmitting means comprising a driving sleeve rotatable in said second bearing member and operative to drive said second end portion of said stencil, and carrying said drive gear.

10. In a screen printing machine, a combination comprising a frame; first and second bearing members mounted in said frame; an elongated hollow stencil having first and second end portions rotatably supported by said first and second bearing members; a prime mover; a first power train drivingly connecting said prime mover with said first end portion of said stencil; and a second power train drivingly connecting said first power train with said second end portion of said stencil, said second power train including a rotary squeegee disposed in the interior of said stencil, means for transmitting torque from said first bearing member, and means including an idler gear which is freely rotatably mounted in said frame and is driven by said squeegee for transmitting torque from said squeegee to said second end portion of said stencil in the region of said second bearing member, said second bearing member having a post normal to the axis of said stencil and said frame having a slot extending transversely of the axis of said stencil and receiving a portion of said post, said second bearing member being pivotable about the axis of said post and said post being movable in said slot, and further comprising means for fixing said second bearing member in a selected position relative to said frame, said means for transmitting torque from said squeegee to said second end portion of said stencil comprising a driving sleeve operative to rotate said second end portion of said stencil and having a first gear, said idler gear being mounted in said frame, driven by said squeegee and meshing with said first gear, said second bearing member comprising a first section which is rigid with said post and a second section which rotatably supports said sleeve.

11. A combination as defined in claim 10, further comprising means for moving one of said sections with respect to the other of said sections in the axial direction of said stencil.

12. A combination as defined in claim 11, wherein said one section is said second section.

13. A combination as defined in claim 11, wherein said means for moving said one section comprises at least one fluid-operated motor.

14. In a screen printing machine, a combination comprising a frame; first and second bearing members mounted in said frame; an elongated hollow stencil having first and second end portions rotatably supported by said first and second bearing members; a prime mover; a first power train drivingly connecting said prime mover with said first end portion of said stencil; and a second power train drivingly connecting said first power train with said second end portion of said stencil, said second power train including a rotary squeegee disposed in the interior of said stencil, means for transmitting torque from said first bearing member, and means including an idler gear which is freely rotatably mounted in said frame and is driven by said squeegee for transmitting torque from said squeegee to said second end portion of said stencil in the region of said second bearing member, said first power train comprising a first driving sleeve rotatably mounted in said first bearing member and means for drivingly coupling said first sleeve to the said first end portion of said stencil, said means for transmitting torque from said squeegee to said second end portion of said stencil comprising a second driving sleeve rotatably mounted in said second bearing member, means for drivingly coupling said second sleeve to said second end portion of said stencil, a first gear rigid with said squeegee, said idler gear being rotatably mounted in said frame and meshing with said first gear, and a third gear rigid with said second sleeve and meshing with said idler gear.

15. A combination as defined in claim 14, wherein at least one of said sleeves is adjustable relative to the respective bearing member.

16. In a screen printing machine, a combination comprising a frame; first and second bearing members mounted in said frame; an elongated hollow stencil having first and second end portions rotatably supported by said first and second bearing members; a prime mover; a first power train drivingly connecting said prime mover with said first end portion of said stencil; and a second power train drivingly connecting said first power train with said second end portion of said stencil, said second power train including a rotary squeegee disposed in the interior of said stencil, means for transmitting torque from said first bearing member, and means including an idler gear which is freely rotatably mounted in said frame and is driven by said squeegee for transmitting torque from said squeegee to said second end portion of said stencil in the region of said second bearing member, said squeegee comprising coaxial first and second stubs which respectively extend into said first and second bearing members, said first power train comprising a first driving sleeve rotatable in said first bearing member, spacedly surrounding said first stub and operative to rotate said first end portion of said stencil, a first gear receiving torque from said prime mover and rotatably mounted in said frame, and a second gear rigid with said sleeve and meshing in the said first gear, said means for transmitting torque from said first power train to said squeegee comprising a third gear rigid with said first stub and meshing with said first gear, said means for transmitting torque from said squeegee to said second end portion of said stencil comprising a second driving sleeve rotatably mounted in said second bearing member, spacedly surrounding said second stub and operative to rotate said second end portion of said stencil, a fourth gear rigid with said second stub, said idler gear being rotatably mounted in said frame and meshing with said fourth gear, and a sixth gear rigid with said second sleeve and meshing with said idler gear.

17. A combination as defined in claim 16, wherein the axes of said first, second and third gears are located in a common plane and those teeth of said second and third gears which mate with the teeth of said first gear are aligned with each other.

18. A combination as defined in claim 16, wherein the axes of said fourth and sixth gears are coplanar with the axis of said idler gear at least at times and those teeth of said fourth and sixth gears which mate with the teeth of said idler gear are aligned with each other.

19. A combination as defined in claim 16, wherein said second and third gears are located at a level above said first gear and said fourth and sixth gears are located at a level above said idler gear.

* * * * *